US011839944B2

(12) United States Patent
Zhu et al.

(10) Patent No.: US 11,839,944 B2
(45) Date of Patent: Dec. 12, 2023

(54) FLOATING NON-CONTACT ULTRASONIC ENHANCED FLEXIBLE SUB-APERTURE POLISHING DEVICE AND METHOD

(71) Applicant: ZHEJIANG UNIVERSITY, Hangzhou (CN)

(72) Inventors: Wule Zhu, Hangzhou (CN); Fang Han, Hangzhou (CN); Lu Wu, Hangzhou (CN); Anyu Sun, Hangzhou (CN); Bingfeng Ju, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 17/891,015

(22) Filed: Aug. 18, 2022

(65) Prior Publication Data

US 2023/0029755 A1 Feb. 2, 2023

Related U.S. Application Data

(63) Continuation of application No. PCT/CN2022/085965, filed on Apr. 8, 2022.

(51) Int. Cl.
*B24B 1/04* (2006.01)
*B24B 41/04* (2006.01)
(Continued)

(52) U.S. Cl.
CPC ..... *B24B 13/012* (2013.01); *B06B 3/02* (2013.01); *B24B 1/04* (2013.01); *B24B 35/00* (2013.01); *B24B 41/04* (2013.01)

(58) Field of Classification Search
CPC ..... B24B 1/04; B24B 13/102; B24B 37/04; B24B 37/046; B24B 41/04; B24B 35/00;
(Continued)

(56) References Cited

U.S. PATENT DOCUMENTS 2,580,716 A * 1/1952 Balamuth ..... B24B 47/04 451/910
2,980,123 A * 4/1961 Lemelson ..... B05B 17/0607 219/121.84
(Continued)

FOREIGN PATENT DOCUMENTS

CN 103831716 A * 6/2014 ..... B24B 1/04
CN 106002543 A 10/2016
(Continued)

OTHER PUBLICATIONS

Internation Search Report of PCT/CN2022/085965, dated Jun. 29, 2022.

*Primary Examiner* — Eileen P Morgan

(57) ABSTRACT

A floating non-contact ultrasonic enhanced flexible sub-aperture polishing device and method are disclosed, an X-axis moving platform, a Y-axis moving platform, a Z-axis moving platform and a workpiece swinging platform in linkage control ensure normal lines of a tool and a workpiece are kept at an identical angle to realize sub-aperture processing; the ventilation main shaft acts air pressure on the ball spline's end portion to form an axial thrust to let the tool axially float; a dynamic balance among hydrodynamic pressure, air pressure and dynamic pressure is performed on the polishing liquid by rotation of the flexible tool; a tiny gap between the tool and workpiece is formed by elastic deformation of the flexible tool due to the dynamic pressure; a shearing force for removing materials is generated when the polishing liquid flows through the gap; a cavitation effect in the gap is formed by ultrasonic waves.

7 Claims, 5 Drawing Sheets

(51) Int. Cl.
*B24B 35/00* (2006.01)
*B06B 3/02* (2006.01)
*B24B 13/01* (2006.01)

(58) Field of Classification Search
CPC ..... B24B 35/005; B24B 13/012; B28D 5/047; B06B 3/00; B06B 3/02
USPC ..... 451/36, 165, 910
See application file for complete search history.

(56) References Cited

U.S. PATENT DOCUMENTS

| | | | | |
|---|---|---|---|---|
| 2018/0250758 | A1* | 9/2018 | Jiang | B23Q 1/0027 |
| 2019/0085933 | A1* | 3/2019 | Chen | B23Q 1/0009 |
| 2020/0180041 | A1* | 6/2020 | Onikura | B23B 37/00 |
| 2022/0227017 | A1* | 7/2022 | Yabe | B26D 7/086 |

FOREIGN PATENT DOCUMENTS

| | | | | | |
|---|---|---|---|---|---|
| CN | 205852411 | U | * | 1/2017 | |
| CN | 107175559 | A | | 9/2017 | |
| CN | 107322375 | A | * | 11/2017 | |
| CN | 108581816 | A | | 9/2018 | |
| CN | 108637801 | A | | 10/2018 | |
| CN | 109202709 | A | * | 1/2019 | |
| CN | 113601320 | A | | 11/2021 | |
| JP | 61030368 | A | * | 2/1986 | |
| JP | 2001038594 | A | | 2/2001 | |
| JP | 2005279902 | A | | 10/2005 | |
| WO | WO-9423935 | A1 | * | 10/1994 | B06B 3/00 |
| WO | WO-2013091166 | A1 | * | 6/2013 | B24B 1/04 |

* cited by examiner

FLOATING NON-CONTACT ULTRASONIC ENHANCED FLEXIBLE SUB-APERTURE POLISHING DEVICE AND METHOD

CROSS-REFERENCE TO RELATED APPLICATIONS

This application is a continuation of International Patent Application No. PCT/CN2022/085965 with a filing date of Apr. 8, 2022, designating the United States, now pending, and further claims priority to Chinese Patent Application No. 202110858172.2 with a filing date of Jul. 28, 2021. The content of the aforementioned applications, including any intervening amendments thereto, are incorporated herein by reference.

TECHNICAL FIELD

The present disclosure relates to technical field of super-precision processing, especially relates to a floating non-contact ultrasonic enhanced flexible sub-aperture polishing device and method.

BACKGROUND

With the development of aerospace, optics, semiconductors and other fields, the requirement on aspheric lens is increasingly extensive. However the traditional processing method is mainly used for processing plane lens. When processing aspheric lens, it can't be competent due to the changing of curvature, the complexity of surfaces, high requirements on processing precision and other factors.

The traditional processing method needs the processing tool and workpiece to be tightly contacted with each other, resulting in that the processing tool fails to follow the workpiece surface, resulting in that the processed surface of the workpiece is far away from an expected surface. Some veterans introduce a method for polishing the workpiece by utilizing the flexible tool that can change its shape based on the surface curvature of the workpiece, tightly contacting the surface, such that the free abrasive particles cannot enter into a gap between the tool and the workpiece. Along with continuous deformation, the tool lacks high efficiency to remove materials since the contact force between the abrasive particles of the flexible tool and the workpiece is very weak. For this reason, some veterans suggest a method of air flotation, the flexible tool is departed away from the workpiece surface, dynamic pressures of free abrasive particles are able to perform shearing action on workpiece surface to remove materials, even though such method can remove materials, the efficiency thereof is quite low, and still needs to be improved.

In order to overcome the above shortage, a floating non-contact ultrasonic enhanced flexible sub-aperture polishing device and method are disclosed: the device and method in such a manner as to an X-axis moving platform, a Y-axis moving platform, a Z-axis moving platform and a workpiece swinging platform provided in linkage control ensures that normal lines of a tool and a workpiece are kept at an identical angle to realize sub-aperture processing; the ball spline shaft having one end portion on which the ventilation main shaft acts air pressure generates an axial thrust to let the tool freely float in an axial direction; a dynamic balance among hydrodynamic pressure, air pressure and dynamic pressure is formed in the polishing liquid along with rotation of the flexible tool, causing the flexible tool to generate elastic deformation; a tiny gap between the tool and workpiece is formed by the elastic deformation and a shearing force for removing materials is generated when the polishing liquid flows through the gap; a cavitation effect in the gap is formed by ultrasonic waves generated by the ultrasonic transducer transmitting through the flexible tool, accelerating the efficiency of removing materials as well as polishing surfaces. Such method has a high degree of process precise, efficiency and extensive use etc., resolving a contradiction between exquisite/sub-exquisite surfaces and a high ratio of removing materials; it is possible to apply such method to accurately and effectively polish surfaces such as plane surfaces, spherical surfaces, aspherical surfaces, free-form surfaces or the like.

SUMMARY

The present disclosure has been made in view of such disadvantages. An object of the present disclosure is to a floating non-contact ultrasonic enhanced flexible sub-aperture polishing device and method.

In order to achieve the object, there is provided a polishing device and method in which an X-axis moving platform, a Y-axis moving platform, a Z-axis moving platform and a workpiece swinging platform provided in linkage control ensures that normal lines of a tool and a workpiece are kept at an identical angle to realize sub-aperture processing; the ball spline shaft having one end portion on which the ventilation main shaft acts air pressure generates an axial thrust to let the tool freely float in an axial direction; a dynamic balance among hydrodynamic pressure, air pressure and dynamic pressure is formed in the polishing liquid along with rotation of the flexible tool, causing the flexible tool to generate elastic deformation; a tiny gap between the tool and workpiece is formed by the elastic deformation and a shearing force for removing materials is generated when the polishing liquid flows through the gap; a cavitation effect in the gap is formed by ultrasonic waves generated by the ultrasonic transducer transmitting through the flexible tool, accelerating the efficiency of removing materials as well as polishing surfaces.

In order to achieve the object, the present disclosure is provided a floating non-contact ultrasonic enhanced flexible sub-aperture polishing device, including: a flexible tool, an amplitude transformer, an ultrasonic transducer, a conductive ring rotor, a conductive ring stator, a connecting shaft, a shaft coupling, a ball spline nut, a ball spline shaft and two axial restraint shaft sleeves;

The ball spline nut is fixed in a ventilation main shaft through a first flange, the ball spline shaft is extending through the ball spline nut, the two axial restraint shaft sleeves are respectively set at two ends of the ball spline nut, in interference connection with the ball spline shaft; one end of the shaft coupling is in interference connection with the ball spline shaft, an opposite end of the shaft coupling is fixedly connected with one end of the connecting shaft; an opposite end of the connecting shaft is extending through the conductive ring stator; the conductive ring rotor is fixedly connected with the connecting shaft; the conductive ring stator is fixed on an axial moving platform through a rotation stop sheet; the connecting shaft is in interference connection with an end portion of the ultrasonic transducer; the ultrasonic transducer is connected with the amplitude transformer via a second flange; the flexible tool is fixed with an output end of the amplitude transformer; the conductive ring stator is coupled with the conductive ring rotor through an electric brush; an input end of the transducer power is coupled with a terminal of the conductive ring rotor.

In an embodiment, the device further comprises a Z-axis moving platform, a supporter, an X-axis moving platform, a Y-axis moving platform and a workpiece swinging platform; the ventilation main shaft is fixedly assembled on the Z-axis moving platform, the conductive ring stator is fixedly assembled on the Z-axis moving platform, the Z-axis moving platform is assembled on the supporter; a workpiece is fixed on the workpiece swinging platform, the workpiece swinging platform is fixed on the Y-axis moving platform, moving direction of the Y-axis moving platform is defined as a vertical direction; the Y-axis moving platform is fixed on the X axis moving platform; the Z-axis moving platform and the X-axis moving platform are in a same plane with the moving directions thereof orthogonal to each other; the X-axis moving platform is fixed on the supporter.

In order to achieve the object, the present disclosure is provided a floating non-contact ultrasonic enhanced flexible sub-aperture polishing method in such a manner as to the above-described device moving close to the workpiece through the Z-axis moving platform; the workpiece swinging platform adjusting processing position through the X-axis moving platform and the Y-axis moving platform, ensuring the tool is capable of processing the workpiece at any position along the X-axis and Y-axis directions (within XY plane); and realizing the sub-aperture processing for an aspherical workpiece by moving the workpiece swinging platform along the X-axis direction to search a position of the tool where normal lines of the tool and the workpiece are kept at a same angle.

In an embodiment, the ball spline shaft has a certain movement allowance in its axial direction; the ball spline shaft having an end portion on which the ventilation main shaft acts air pressure makes the flexible tool to move freely in an axial direction of the ball spline shaft; the stable polishing liquid is sprayed between the flexible tool and the workpiece during processing; the polishing liquid generates a dynamic pressure along with rotation of the flexible tool, the dynamic pressure is balanced with the air pressure acted from the ventilation main shaft.

In an embodiment, the transducer generates ultrasonic waves that are transmitted to the flexible tool through the amplitude transformer, then transmitted to the polishing liquid; the flexible tool includes super-elastic materials; ultrasonic waves pass through the flexible tool to form the ultrasonic waves with a shape resembling the flexible tool; microbubbles are generated in the polishing liquid under the action of ultrasonic waves, then broken due to cavitation effect generated by the ultrasonic waves; micro-jets generated when the microbubbles are broken are capable to generate local turbulence in a gap between the tool and the workpiece; the local turbulence promotes collision and rub between abrasive particles and atoms on a surface of the workpiece, driving the abrasive particles to remove materials under a shear force generated in the polishing liquid.

In an embodiment, the dynamic pressure generated by the polishing liquid is balanced with the air pressure from the ventilation main shaft, due to rotation of the flexible tool 101 as one way, or a preloaded spring and a heavy object for pulling are used as an alternative way.

In an embodiment, a tiny gap between the tool and workpiece is formed by elastic deformation of the flexible tool due to the dynamic pressure, a shearing force for removing materials is generated in the gap when the polishing liquid flows through the gap; the shearing force is distributed in gradient, the closer to the workpiece, the shearing force applied to a surface of the workpiece is larger, the free abrasive particles are driven to contact the surface of the workpiece to remove materials thereon under the shearing force.

The beneficial effects of the present disclosure are:

Compared with the existing processing method, the present disclosure has the following advantages: first of all, the configuration in such a manner as to normal lines of the tool and the workpiece kept at a same angle realizes the sub-aperture processing for a workpiece with a complex appearance; secondly, a ultrasonic transducer carried on the ventilation main shaft to form a cavitation effect for accelerating the removing process, making up for a shortage that the floating non-contact process as already known has a low processing efficiency. Such method has a high degree of process precision, efficiency and extensive use etc., resolving a contradiction between exquisite/sub-exquisite surfaces and a high ratio needed for removing materials; it is possible to apply such method to accurately and effectively polish surfaces such as plane surfaces, spherical surfaces, aspherical surfaces, free-form surfaces or the like.

DETAILED DESCRIPTION

An embodiment of the present disclosure will be described below while referring to the attached FIGS. 1 to 5.

Figure 1:
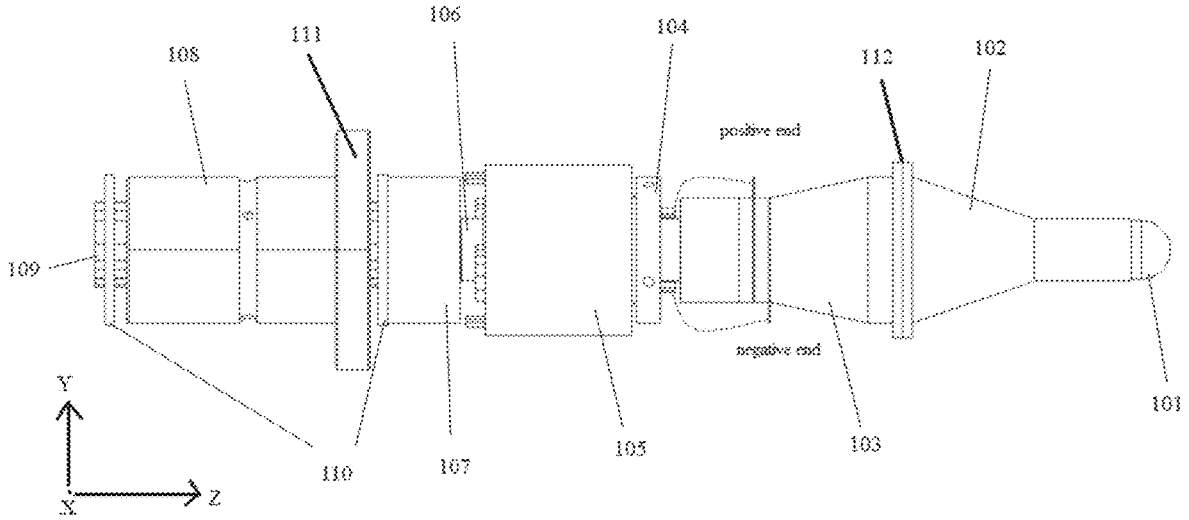
FIG. 1 is a schematic structural view of a ball spline shaft in a floating non-contact ultrasonic enhanced flexible sub-aperture polishing device according to embodiments of the present disclosure.

As shown in FIG. 1, a polishing device used for enhancing sub-aperture process with a floating flexible non-contact ultrasonic comprises a flexible tool 101, an amplitude transformer 102, an ultrasonic transducer 103, a conductive ring rotor 104, a conductive ring stator 105, a connecting shaft 106, a shaft coupling 107, a ball spline nut 108, a ball spline shaft 109 and two axial restrain shaft sleeves 110.

The ball spline nut 108 having a first flange 111 to which a ventilation main shaft 201 is fixedly connected, the ball spline shaft 109 is extending through the ball spline nut 108, the two axial restrain shaft sleeves 110 are respectively set at two ends of the ball spline nut 108 in interference connection with the ball spline shaft 109; one end of the shaft coupling 107 is in interference connection with the ball spline shaft 109, the connecting shaft 106 having one end to which the shaft coupling 107 is thread connected, the connecting shaft 106 having the other end passes through the conductive ring rotor 104; the conductive ring rotor 104 is fixedly connected with the connecting shaft 106 through four screws; the conductive ring stator 105 is thread connected with a supporter through a rotation stop sheet; the connecting shaft 106 is in interference connection with an end portion of the ultrasonic transducer 103; the ultrasonic transducer 103 is connected with the amplitude transformer 102 via a second flange 112; the flexible tool 101 is fixed with a narrower end of the amplitude transformer 102. The conductive ring stator 105 is coupled with the conductive ring rotor 104 through an electric brush; an input end of the transducer power is coupled with a terminal of the conductive ring rotor 104.

The arrangement of the ball spline nuts 108 and the ball spline shaft 109 can not only transmit the rotation of the ventilation main shaft 201 towards the flexible tool 101, but also realize movement of the flexible tool 101 in the axial direction of the main shaft 201. The two axial restrain shaft sleeves 110 are configured for restraining the movement range of the main shaft 201 relative to the ball spline nut 108, the axial movement distance of the flexible tool 101 is controlled within 2 mm.

Figure 2:
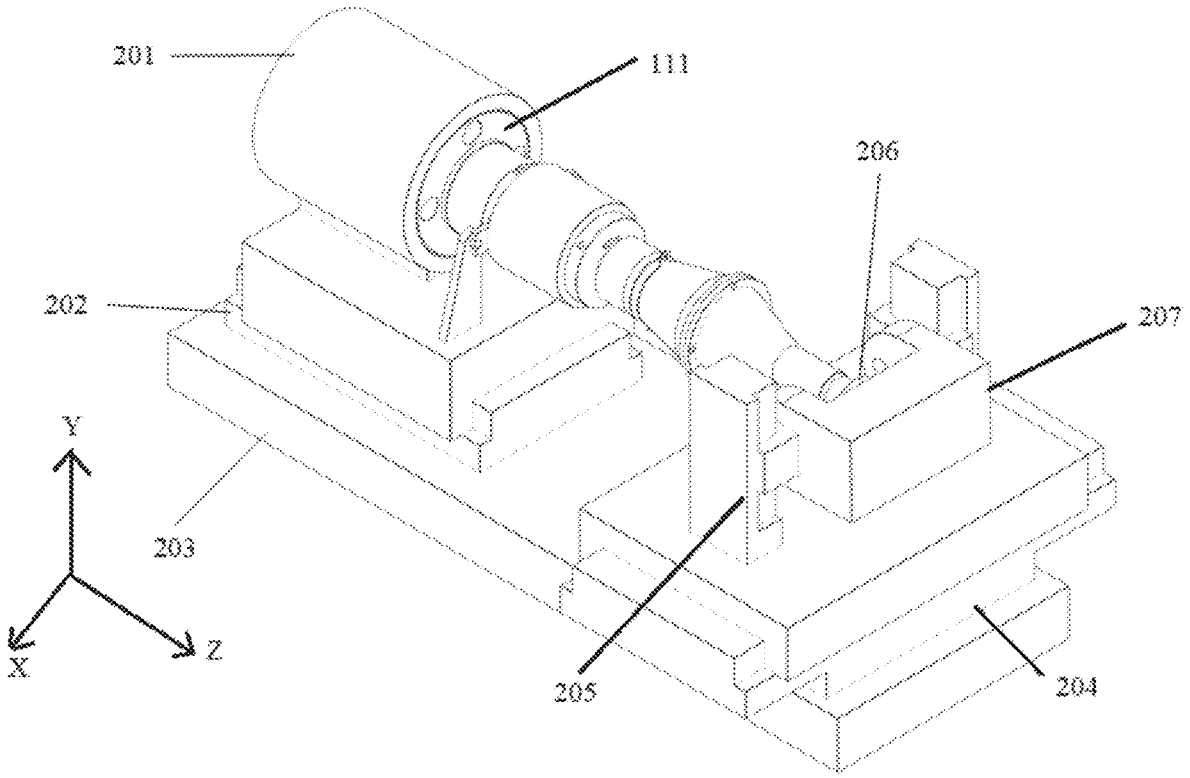
FIG. 2 is a schematic structural view of the floating non-contact ultrasonic enhanced flexible sub-aperture polishing device according to embodiments of the present disclosure.

As shown in FIG. 2, the device further comprises the ventilation main shaft 201, a Z-axis moving platform 202, a supporter 203, an X-axis moving platform 204, a Y-axis moving platform 205, a workpiece 206 and a workpiece swinging platform 207.

The ball spline nut 108 is fixed on the ventilation main shaft 201 via the first flange 111, the ventilation main shaft 201 having a base which is fixedly assembled on the Z-axis moving platform 202 via screws, the Z-axis moving platform 202 having two supporting members on which the conductive ring stator 105 is fixedly assembled on, the Z-axis moving platform 202 is assembled on the supporter 203; a workpiece 206 is fixed on the workpiece swinging platform 207, the workpiece swinging platform 207 is fixed on the Y-axis moving platform 205 that is fixed on the X axis moving platform 204, of which, a moving direction of the Y-axis moving platform 205 is defined as a vertical direction; the Z-axis moving platform 202 and the X-axis moving platform 204 are in a same plane with the moving directions thereof orthogonal to each other; the X-axis moving platform 204 is fixed on the supporter 203.

Figure 3:
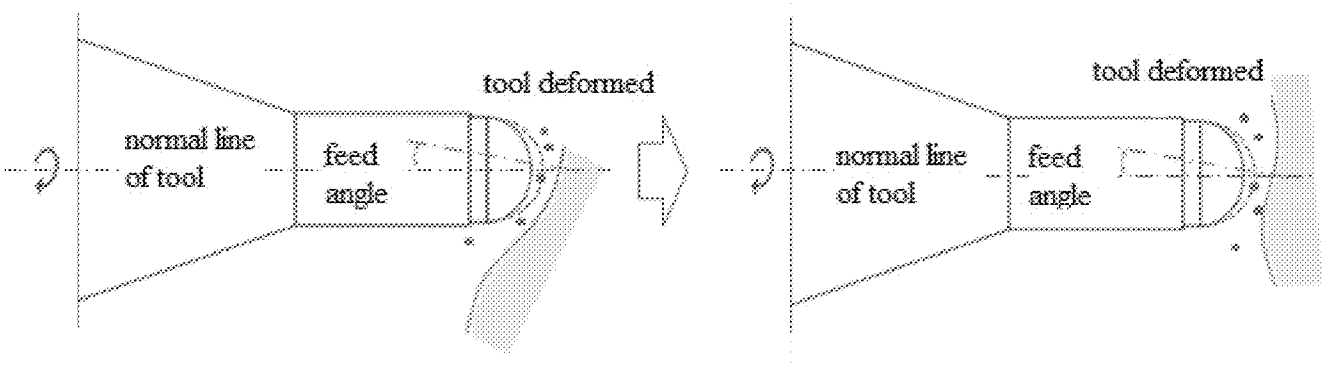
FIG. 3 shows the sub-aperture processing principle.

As shown in FIG. 3, the floating non-contact ultrasonic enhanced flexible sub-aperture polishing device moves close to the workpiece piece 206 in a direction of the Z-axis moving platform 202. The workpiece swinging platform 207 is capable of adjusting processing position through the X axis moving platform 204 and the Y-axis moving platform 205, ensuring the flexible tool 101 to move at arbitrary position on XY directions to machine the workpiece 206. The workpiece swinging platform 202 can swing around the A shaft, realizing the sub-aperture processing for an aspherical workpiece by moving the workpiece swinging platform 207 to search a position of the tool where normal lines of the tool and the workpiece 206 are kept at a same angle.

Figure 4:
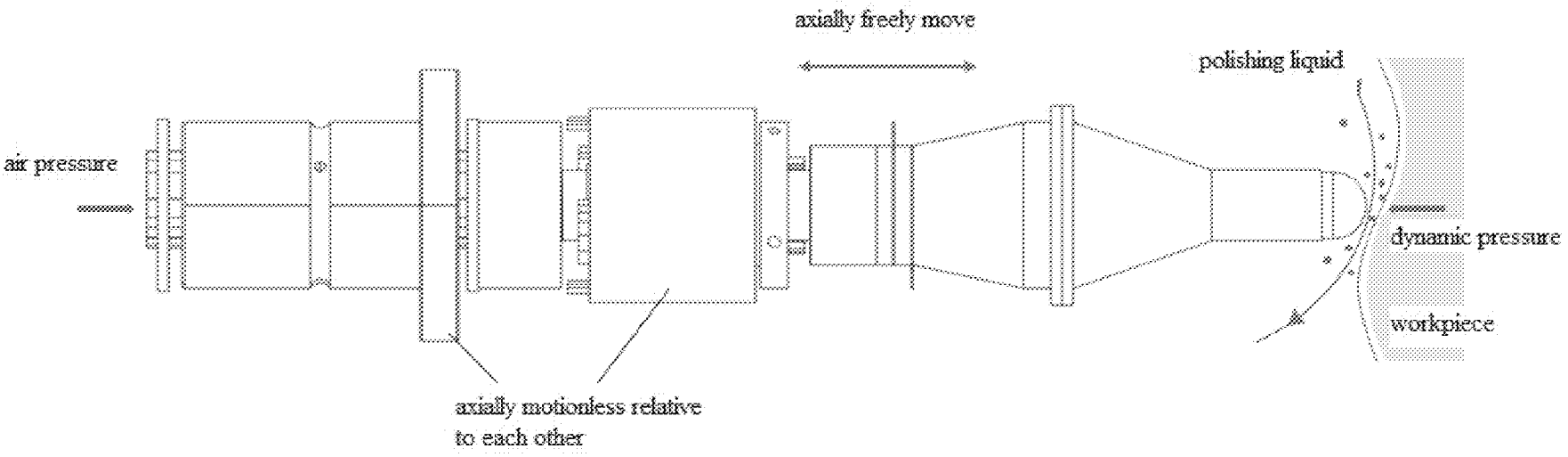
FIG. 4 shows the floating non-contact ultrasonic enhanced flexible sub-aperture polishing method according to embodiments of the present disclosure.

As shown in FIG. 4, the ball spline shaft 109 has a certain movement allowance in its axial direction; the ball spline shaft 109 having an inner end portion on which the ventilation main shaft 201 acts air pressure makes the device 101 to move freely in an axial direction of the ball spline shaft 109; the stable polishing liquid is sprayed between the flexible tool 101 and the workpiece 206 during working and processing; the polishing liquid generates a dynamic pressure along with rotation of the flexible tool 101, the dynamic pressure is balanced with the air pressure acted from the ventilation main shaft 201. A tiny gap between the tool and workpiece 206 is formed by elastic deformation of the flexible tool 101 which is caused by the dynamic pressure; a shearing force for removing materials is generated in the gap when the polishing liquid flows through the gap; the shearing force is distributed in gradient, closer to the workpiece 206 the shearing force applied to a surface of the workpiece 206 is larger, the free abrasive particles are driven to contact the surface of the workpiece 206 to remove materials thereon under the shearing force.

Figure 5:
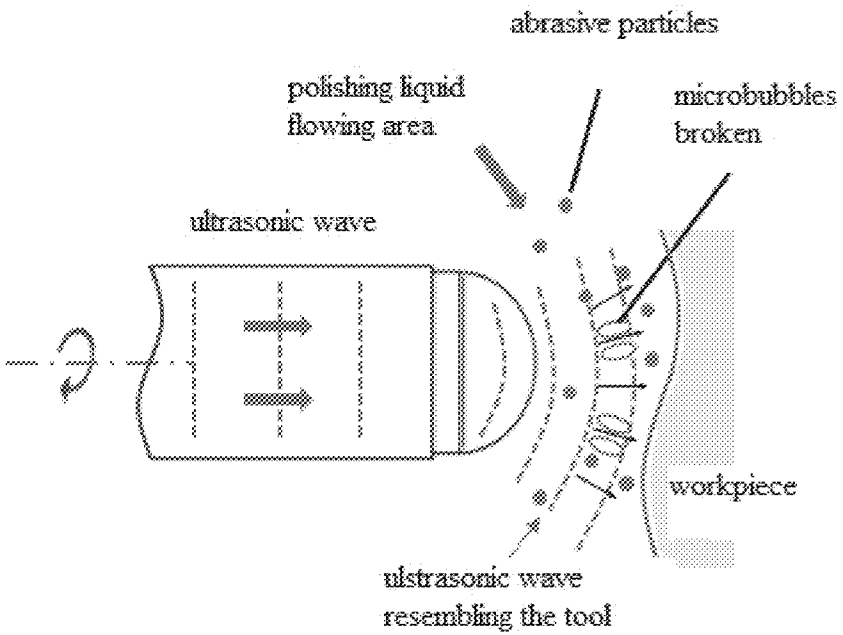
FIG. 5 shows the cavitation effect principle.

As shown in FIG. 5, the conductive ring rotor 104 having two terminals with which a positive end and negative end of the transducer power are respectively connected. The transducer power generates ultrasonic wave, transmitting the ultrasonic wave to the flexible tool 101 through the amplitude transformer 102, eventually the ultrasonic wave is transmitted to the polishing liquid; the flexible tool 101 includes super-elastic materials that has little attenuation of the waves. The ultrasonic wave passes through the flexible tool 101 to form an ultrasonic wave with a shape resembling the flexible tool 101. Microbubbles are generated in the polishing liquid under the action of the ultrasonic wave, and then broken due to cavitation effect generated by the ultrasonic wave. Micro-jets generated when the microbubbles are broken are capable to generate a local turbulence in a gap between the tool and the workpiece 206, the local turbulence promotes collision and rub between abrasive particles and atoms on the surface of the workpiece 206, Accordingly, it is possible to drive the abrasive particles to remove materials under a shear force generated in the polishing liquid, as well as improve the polishing efficiency.

An embodiment of the present invention has been heretofore described above. However, the present invention is not limited to above mentioned embodiment, and the prior arts when implementing the present invention and relating to the gist of the present invention are no need to be described herein, such as the detailed cleaning principle of cavitation effect, the principle of transmitting and adjusting ultrasonic wave and the like.

The above embodiments only illustrate the technical ideas and features of the present invention, and the purpose is to enable those skilled in the art to understand the contents of the present invention and implement it, and cannot limit the protection scope of the present invention. The equivalent changes or modifications made according to the spirit of the present invention should be covered in the protection scope of the present invention. Unless particularly specified, the technical means used in the embodiments are conventional means well known to those skilled in the art.

What is claimed is:

1. A floating non-contact ultrasonic enhanced flexible sub-aperture polishing device comprising:

a flexible tool (101);

an amplitude transformer (102);

an ultrasonic transducer (103);

a conductive ring rotor (104);

a conductive ring stator (105);

a connecting shaft (106);

a shaft coupling (107);

a ball spline nut (108);

a ball spline shaft (109);

two axial restraint shaft sleeves (110);

wherein the ball spline nut (108) is fixed in a ventilation main shaft (201) through a first flange, the ball spline shaft (109) is extending through the ball spline nut (108); the two axial restraint shaft sleeves (110) are respectively set at two ends of the ball spline nut (108) in interference connection with the ball spline shaft (109); one end of the shaft coupling (107) is in interference connection with the ball spline shaft (109), the other end of the shaft coupling (107) is fixedly connected with one end of the connecting shaft (106); the other end of the connecting shaft (106) is extending through the conductive ring stator (105); the conductive ring rotor (104) is fixedly connected with the connecting shaft (106); the conductive ring stator (105) is fixed on an axial moving platform through a rotation stop sheet; the connecting shaft (106) is in interference connection with an end portion of the ultrasonic transducer (103); the ultrasonic transducer (103) is connected with the amplitude transformer (102) via a second flange; the flexible tool (101) is fixed with an output end of the amplitude transformer (102); the conductive ring stator (105) is coupled with the conductive ring rotor (104) through an electric brush; a positive end and a negative end of a transducer power of the ultrasonic transducer are respectively coupled with two terminals of the conductive ring rotor (104).

2. The device according to claim 1, wherein the device further comprises a Z-axis moving platform (202), a supporter (203), an X-axis moving platform (204), a Y-axis moving platform (205) and a workpiece swinging platform (207);

wherein the ventilation main shaft (201) is fixedly assembled on the Z-axis moving platform (202), the conductive ring stator (105) is fixedly assembled on the Z-axis moving platform (202), the Z-axis moving platform (202) is assembled on the supporter (203); a workpiece (206) is fixed on the workpiece swinging platform (207), the workpiece swinging platform (207) is fixed on the Y-axis moving platform (205), moving direction of the Y-axis moving platform (205) is defined as a vertical direction;

the Y-axis moving platform (205) is fixed on the X axis moving platform (204); the Z-axis moving platform (202) and the X-axis moving platform (204) are in a same plane with the moving directions thereof orthogonal to each other; the X-axis moving platform (204) is fixed on the supporter (203).

3. A polishing method of utilizing the floating non-contact ultrasonic enhanced flexible sub-aperture polishing device of claim 2, comprising:

moving the device close to the workpiece through the Z-axis moving platform wherein the workpiece is and aspherical workpiece;

adjusting a processing position through the X-axis moving platform and the Y-axis moving platform, ensuring the flexible tool is capable of processing the workpiece at any position along the X-axis and Y-axis directions; and realizing a sub-aperture processing for the workpiece by moving the workpiece swinging platform along the X-axis direction to search a position of the tool where normal lines of the flexible tool and the workpiece are kept at a same angle.

4. The polishing method according to claim 3, further comprising:

driving the flexible tool to move freely in an axial direction of the ball spline shaft through acting air pressure on an end portion of the ball spline shaft by the ventilation main shaft, wherein the ball spline shaft has a certain movement allowance in its axial direction;

spraying polishing liquid stably between the flexible tool and the workpiece during the sub-aperture processing, wherein the polishing liquid generates a dynamic pressure along with rotation of the flexible tool, and the dynamic pressure is balanced with the air pressure acted from the ventilation main shaft.

5. The polishing method according to claim 4, further comprising:

generating an ultrasonic wave by the transducer generates;

transmitting the ultrasonic wave to the flexible tool through the amplitude transformer, wherein the flexible tool includes super-elastic materials, the ultrasonic wave passes through the flexible tool to form an ultrasonic wave with a shape resembling the flexible tool;

transmitting the ultrasonic wave to the polishing liquid through the flexible tool, wherein microbubbles are generated in the polishing liquid under the action of the ultrasonic wave, then broken due to cavitation effect generated by the ultrasonic wave;

generating local turbulence in a gap between the flexible tool and the workpiece through micro-jets generated when the microbubbles are broken, wherein the local turbulence promotes collision and rub between abrasive particles and atoms on a surface of the workpiece;

driving the abrasive particles to remove materials of the workpiece under a shear force generated in the polishing liquid.

6. The polishing method according to claim 4, further comprising:

rotating the flexible tool to balance the dynamic pressure generated by the polishing liquid with the air pressure from the ventilation main shaft.

7. The polishing method according to claim 4, further comprising:

forming a tiny gap between the flexible tool and the workpiece by elastic deformation of the flexible tool due to the dynamic pressure;

generating a shearing force for removing materials in the gap when the polishing liquid flows through the gap;

distributing the shearing force in gradient, the closer to the workpiece, the shearing force applied to a surface of the workpiece is larger;

driving the abrasive particles to contact the surface of the workpiece to remove materials under the shearing force.

* * * * *